US006173457B1

(12) United States Patent
Higgins

(10) Patent No.: US 6,173,457 B1
(45) Date of Patent: Jan. 16, 2001

(54) FLAPPER-TYPE FLUSH VALVE AND MOUNTING ADAPTER

(76) Inventor: Gary R. Higgins, 635 St. Ann's Dr., Laguna Beach, CA (US) 92651

( * ) Notice: Under 35 U.S.C. 154(b), the term of this patent shall be extended for 0 days.

(21) Appl. No.: 09/336,227

(22) Filed: Jun. 18, 1999

Related U.S. Application Data

(60) Provisional application No. 60/089,955, filed on Jun. 19, 1998, and provisional application No. 60/089,826, filed on Jun. 19, 1998.

(51) Int. Cl.[7] ..... E03D 1/35

(52) U.S. Cl. ..... 4/393; 4/404; 4/415

(58) Field of Search ..... 4/392–404, 415, 4/324, 325, 39.5; 137/391, 395, 434, 4.42, 362; 251/356, 298, 357

(56) References Cited

U.S. PATENT DOCUMENTS

| | | | | |
|---|---|---|---|---|
| 3,368,224 | * | 2/1968 | Ament | 4/393 |
| 4,254,938 | * | 3/1981 | Inada et al. | 251/367 |
| 4,497,076 | * | 2/1985 | Sullivan | 4/393 |
| 5,072,751 | * | 12/1991 | Lin | 137/442 |
| 5,230,103 | * | 7/1993 | Antunez | 4/404 |
| 5,390,375 | * | 2/1995 | Fernstrum, Jr. | 4/404 |

FOREIGN PATENT DOCUMENTS

| | | | | |
|---|---|---|---|---|
| 2106155 | * | 4/1983 | (GB) | 4/395 |

* cited by examiner

*Primary Examiner*—Henry J. Recla
*Assistant Examiner*—Tuan Nguyen
(74) *Attorney, Agent, or Firm*—Howard M. Cohn

(57) ABSTRACT

A flapper-type toilet flush valve having multiple components. A float member component is assembled to a flapper body component. Both components are made of resilient plastic compounds that resist chlorine and chemical bleaches of the type commonly used in tank style toilets. A pair of arms extend from the flapper body component for pivotally mounting the flush valve to corresponding trunnions on an overflow pipe in the toilet tank. An annular recess in the lower surface of the flapper body component has lugs, and corresponding teeth are provided on a top edge of the float member component for mating with the locking lugs. An annular flange extends from the float member component near its top edge to form a first sealing surface. A portion of the lower surface of the flapper body component forms a second sealing surface. A replaceable seal ring is disposed between the first and second sealing surfaces. A mounting adapter, comprising a collar having trunnions is provided for overflow pipes lacking trunnions. The collar is slid down over the overflow pipe into a selected position, and secured in place by a C-shaped spring which fits snugly about an outer surface of the collar to secure the collar in place on the overflow pipe.

16 Claims, 5 Drawing Sheets

FLAPPER-TYPE FLUSH VALVE AND MOUNTING ADAPTER

CROSS-REFERENCE TO RELATED APPLICATIONS

This is a continuation-in-part of copending U.S. Provisional Patent Applications Nos. 60/089,955 filed Jun. 19, 1998 by Gary Higgins, and 60/089,826 filed Jun. 19, 1998 by Gary Higgins.

TECHNICAL FIELD OF THE INVENTION

The present invention relates to flapper-type flush valves (sometimes referred to as "flapper valves") for toilets, particularly for tank-style, gravity flow toilets.

BACKGROUND OF THE INVENTION

A typical tank-style, gravity flow toilet comprises a tank and a bowl. The purpose of the tank is to receive and store a quantity of water for flushing the toilet. A ball cock assembly is disposed in the tank, and includes an inlet tube that allows water under pressure to flow into the tank, to a predetermined level (quantity). A water supply line is connected to the ball cock assembly. A flush valve is disposed in the tank and, when operated, allows the quantity of water stored in the tank to be delivered to the bowl for flushing the toilet. A typical flush valve is a "flapper-type" flush valve, including a disc-like "flap" which closes off an end of a discharge pipe. A flush lever controls the operation of the flush valve. The bowl sits atop a sewage pipe. A seat and lid are disposed atop the bowl.

FIG. 1 illustrates an exemplary flapper-type flush valve 100 of the prior art, the structure and operation of which is well known. The flush valve 100 comprises an upper flapper body portion 102 and a lower float member portion 104. The flapper body portion 102 is generally in the form of a disc, having an upper surface 102*a* and a lower surface 102*b*. The float member portion 104 extends from the lower surface 102*b* of the flapper body portion 102. A pair of generally parallel, spaced-apart arms 106 extend in a rearward direction from a rearward position (right hand side, as viewed) of the flapper body portion 102. A hole 108 is provided in a distal end of each arm 106 for pivotally securing the flush valve 100 to a corresponding pair of pins or trunnions 110 extending from an overflow pipe 112. The trunnions 110 are disposed at diametrically-opposed positions on an outer surface of the overflow pipe 112. The rearward-extending arms 106 and trunnions 110 extending through the holes 108 serve to position and align the flush valve 100, and to guide the flush valve 100 as it moves between a "closed" position and an "open" position.

In FIG. 1, the flush valve 100 is illustrated as being in a "closed" position. In this closed position, the lower surface 102*b* of the flapper body portion 102 sealingly engages a top end 114*a* of a discharge pipe (flush outlet) 114, the top end of the discharge pipe 114 functioning as a valve seat. The discharge pipe 114 has a diameter sufficiently large that the float member portion 104 fits easily within the bore of the discharge pipe 114. The float member portion 104 also helps to center the flapper body portion 102 on the top end 114*a* of the discharge pipe 114.

A chain (e.g., ball chain or "S" chain) or strap 116 extends from a flush lever lift arm (not shown) to a mounting lug 118 which is disposed on the front (left, as viewed) of the flapper body portion 102, generally diametrically-opposed to the rearwardly-extending arms 106. When the flush lever lift arm is momentarily operated depressed, the chain 116 pulls upward on the flush valve 100, causing the flapper body portion 102 to move away from the top end 114*a* of the discharge pipe 114, thereby "opening" the flush valve 100. In this "open" position, water (not shown) in the toilet tank (not shown) is allowed to flow into the toilet bowl (not shown) to "flush" the toilet. As the water level in the toilet tank is replenished, at the end of the flush cycle, the flush valve 100 automatically returns to its "closed" position.

The float member portion 104 is cup-shaped, defining an air chamber 120. The air chamber 120 is typically sized to contain 2.25 to 2.50 cubic inches of air. An opening 122 is provided at the base of the float member portion 104. In use, when the flush valve 100 is opened, the buoyancy of the air inside the air chamber 120 assists in maintaining the flush valve 100 in the open position until the water level drops below the float member portion 104, at which time the weight of the flapper body portion 102 causes the flush valve to drop and close.

The flapper body portion 102, float member portion 104, rearwardly-extending arms 106 and the mounting lug 118 are typically integrally formed of a resilient material, such as soft rubber or an elastomer. In the event of a failure of only a portion of such an integrally-formed flush valve 100, the entire flush valve 100 would need to be replaced. The discharge pipe 114, the top end 114*a* of which serves as a valve seat for the flush valve 100, is a part of the toilet, not a part of the flush valve 100.

The operation of a tank-style, gravity flow toilet, such as has been described with respect to FIG. 1, is generally well known. The tank typically holds (stores) anywhere from about 1.6 gallons to about 8 gallons of water. When the water in the tank is released by opening the flush valve, the first few gallons of water are forced into the toilet bowl by volume and weight of the remaining water in the tank. As the water flows through the toilet bowl and down into the sewer drain, it creates a suction which pulls all the waste and water from the toilet bowl, assisted by ambient air pressure. This method of eliminating liquid or solid waste from the toilet bowl is referred to as "siphon jet action". The siphon jet action only requires a few gallons to work efficiently. The balance (remainder) of the water in the toilet tank serves to generate the force and velocity to drive the first few gallons from the toilet tank into the toilet bowl with sufficient force to sustain the siphon jet action.

Typical tank-style gravity-flow toilets (3.5 gallons or larger) use substantially all of the water that is stored in the toilet tank to flush the toilet bowl. It has been recognized that this practice is somewhat wasteful, and has contributed to a sewage waste water problem. Government regulations have been directed to reducing the quantity of water that a toilet may use to flush waste from the toilet bowl. Currently, most states have adopted regulations that require toilets used in new construction to use no more than 1.6 gallons of water per flush. However, there are millions of older style toilets in use that use 3.5 gallons, or more, of water per flush.

SUMMARY OF THE INVENTION

An object of the invention is to provide an improved flapper-type flush valve for tank-style, gravity flow toilets.

Another object of the invention to provide a flapper flush valve as an assembly of cooperating components—for example, as a four piece assembly including an adapter collar, and a three-piece body comprising an upper flapper body, a float member and a seal ring. In this manner, in the event of failure, only the faulty component of the flush valve need be replaced.

Another object of the invention is to provide a flapper flush valve that can inexpensively be fabricated and mass-produced using high volume plastic injection molding equipment.

Another object of the invention is to construct a flapper flush valve of inexpensive polymer compounds which are extremely resistant to chlorine and commercially available bleach tablets that are commonly used in conventional toilet tanks to sanitize the tank and the bowl.

Another object of the invention is to provide an improved adapter collar for mounting the flapper flush valve to an existing overflow pipe in the toilet tank.

Another object of the invention is to provide a technique for controlling a rate at which a flapper-type toilet flush valve closes, thereby controlling (reducing) an amount of water used to flush a standard tank-style, gravity flow toilet.

Another object of the invention is to provide an air control valve that can be easily installed into an opening located at the base of the float member of a standard toilet flapper valve and easily adjusted to provide the means of reducing the amount of water used to flush the toilet.

Another object of the invention is to provide an air control valve that can be inexpensively mass-produced.

According to the invention, a flapper-type toilet flush valve comprises a flapper body component, and a float member component which is assembled to the flapper body component. Both components are made of resilient plastic compounds that resist chlorine and chemical bleaches of the type commonly used in tank style toilets. A pair of arms extend from the flapper body component for pivotally mounting the flush valve to corresponding trunnions on an overflow pipe in the toilet tank.

According to an aspect of the invention, an annular recess is formed in the lower surface of the flapper body component. A plurality of spaced-apart locking lugs are provided on an inside surface of the annular recess. A plurality of spaced-apart teeth are provided on a top edge of the float member component for mating with the locking lugs, thereby enabling rapid assembly and disassembly of the float member component to the flapper body component.

According to an aspect of the invention, an annular flange extends from the float member component near its top edge, a top surface of the flange forming a first sealing surface. A portion of the lower surface of the flapper body component forms a second sealing surface. A replaceable seal ring is disposed between the first and second sealing surfaces.

According to an aspect of the invention, a mounting adapter, comprising a collar having trunnions is provided for overflow pipes lacking trunnions. The collar is slid down over the overflow pipe into a selected position, and secured in place by a C-shaped spring which fits snugly about an outer surface of the collar to secure the collar in place on the overflow pipe.

According to another aspect of the invention, an adjustable air control valve is disposed in an opening of a float member of a flapper-type flush valve to control the rate at which the flush valve closes. The float member may be a portion of a conventional (standard) flapper-type flush valve, or a may be a component of the inventive flush valve described herein. In a preferred embodiment, the air control valve comprises a valve body having a bore, and a valve core which can be threaded into the valve body. The valve can be adjusted between substantially a fully closed position and a fully opened position by threading the valve core partially or fully into or out of the bore of the valve body. Air flow channels and a tapered surface are provided on the valve core. A corresponding tapered surface is provided in the bore of the valve body. The valve core has two arms which extend through an opening at an end of the valve body. The two arms are pinched together to turn the valve core and, when released, resiliently engage the valve body.

Other objects, features and advantages of the invention will become apparent in light of the following description thereof.

DESCRIPTION OF THE DRAWINGS

Reference will be made in detail to preferred embodiments of the invention, examples of which are illustrated in the accompanying drawings. The drawings are intended to be illustrative, not limiting. Although the invention will be described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Figure 1:
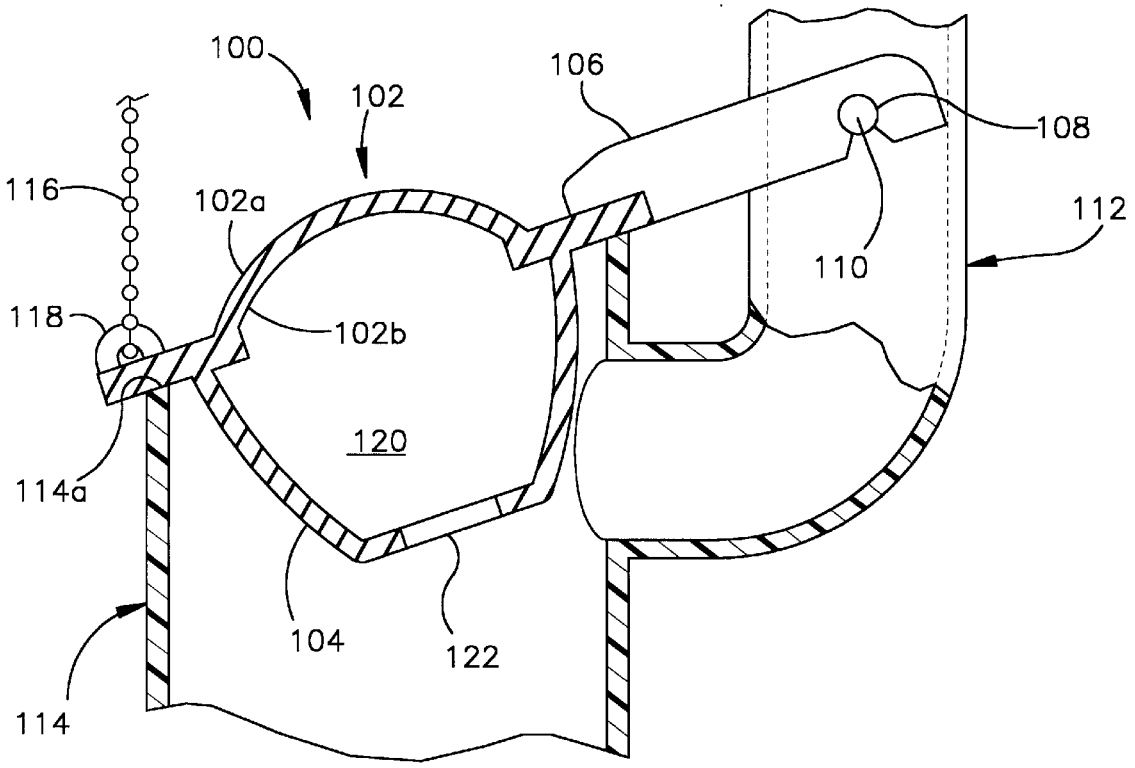
FIGURE 1 (PRIOR ART)
Figure 2:
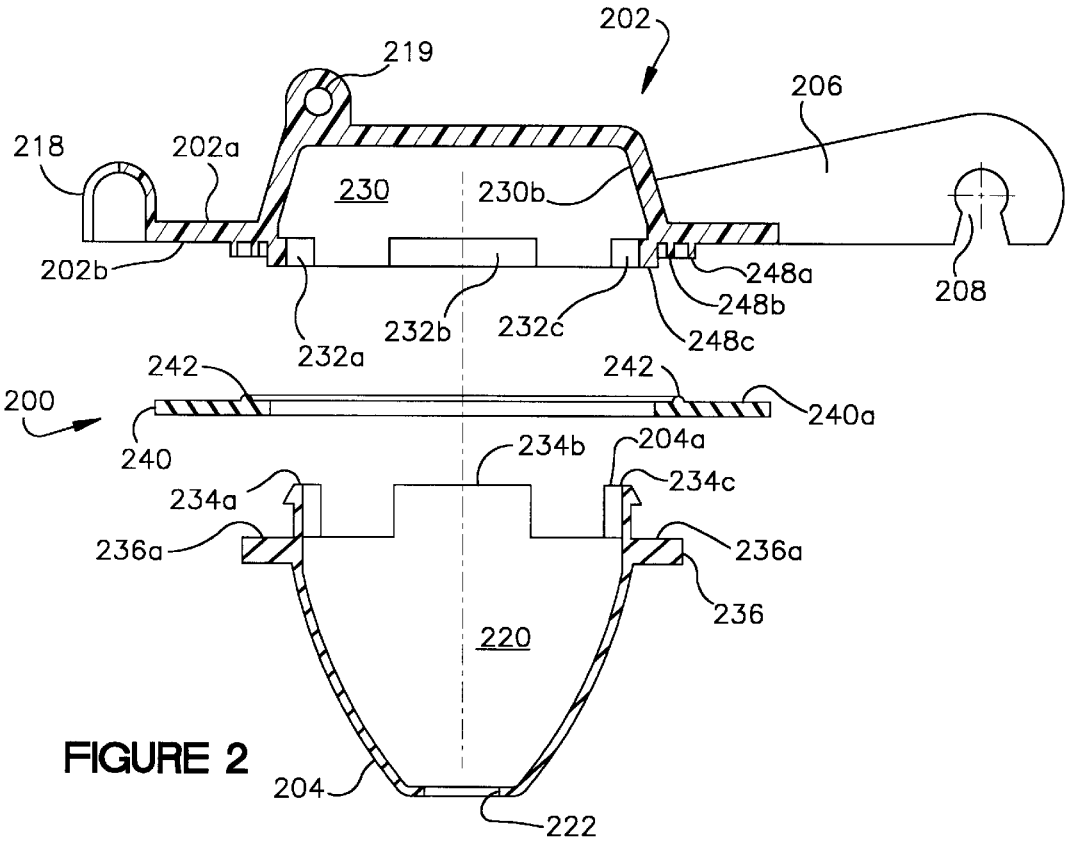

Elements of the figures are typically numbered as follows. The most significant digits (hundreds) of the reference number corresponds to the figure number. Elements of FIG. 1 are typically numbered in the range of 100–199. Elements of FIG. 2 are typically numbered in the range of 200–299. Similar elements throughout the drawings may be referred to by similar reference numerals. For example, the element 199 in a figure may be similar, and possibly identical to the element 299 in an other figure. In some cases, similar (including identical) elements may be referred to with similar numbers in a single drawing. For example, each of a plurality of elements 199 may be referred to individually as 199*a*, 199*b*, 199*c*, etc. Such relationships, if any, between similar elements in the same or different figures will become apparent throughout the specification, including, if applicable, in the claims and abstract.

Figure 3:
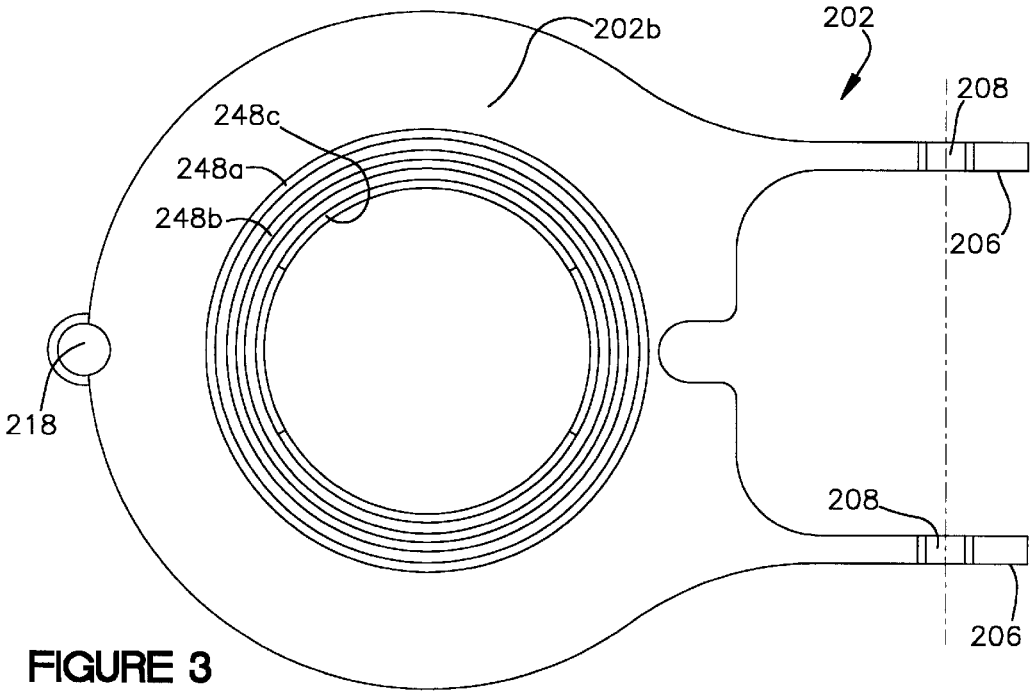
Figure 4:
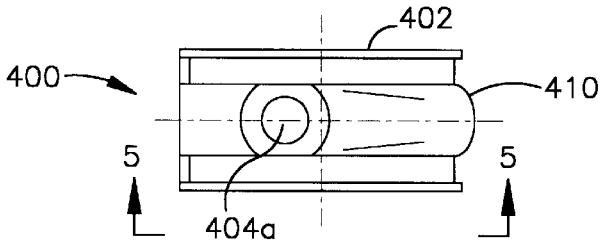
Figure 5:
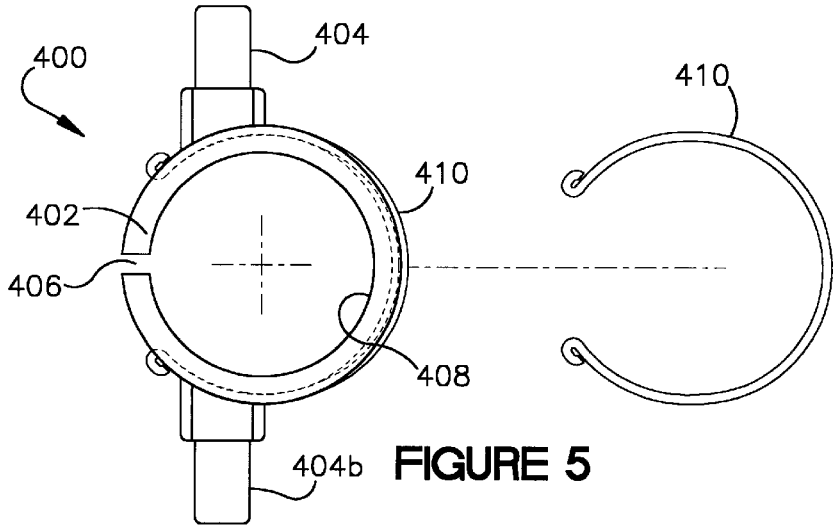
Figure 6A:
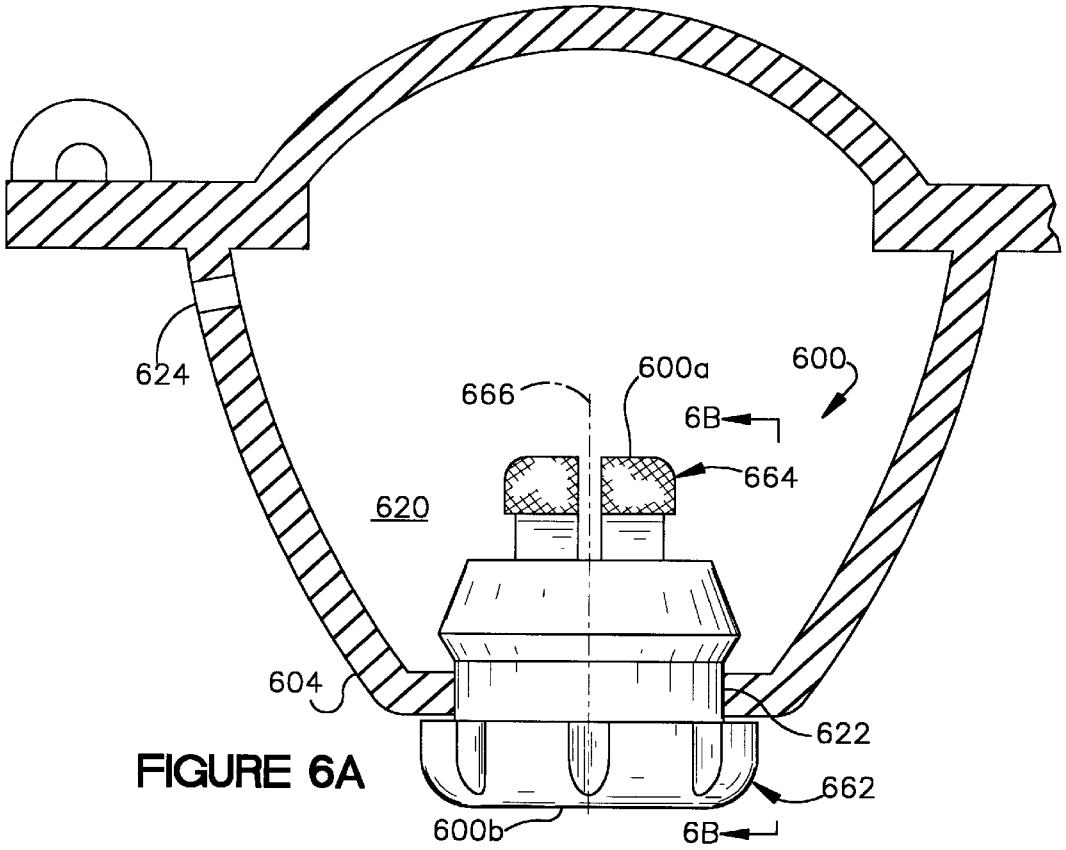
Figure 6B:
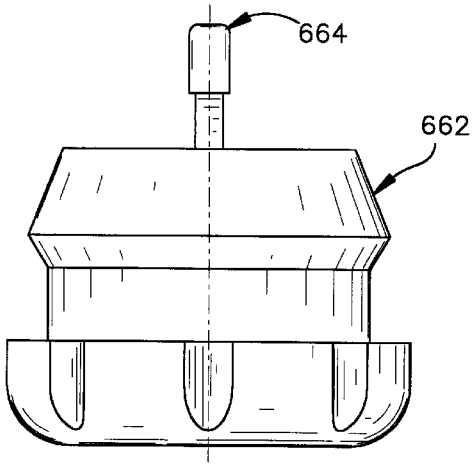
Figure 7A:
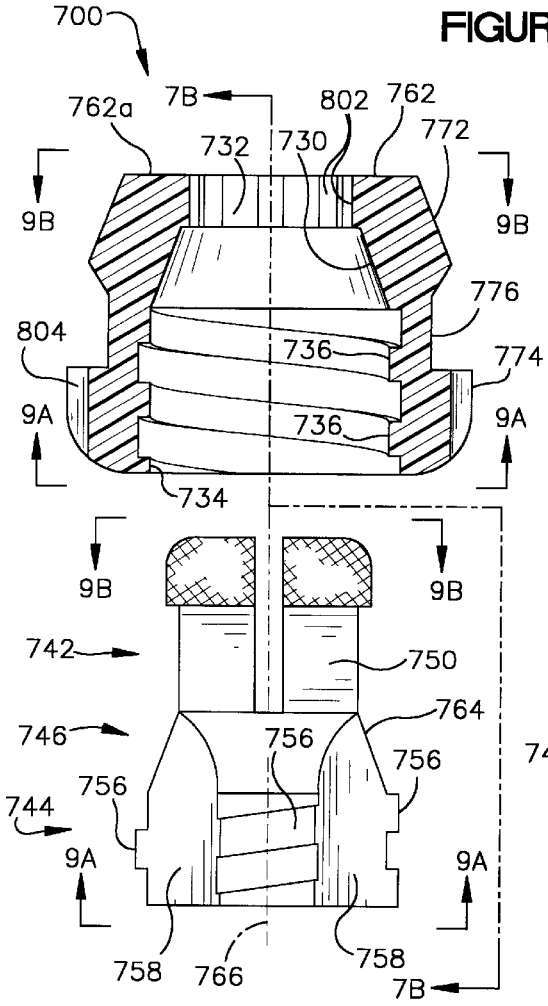
Figure 7B:
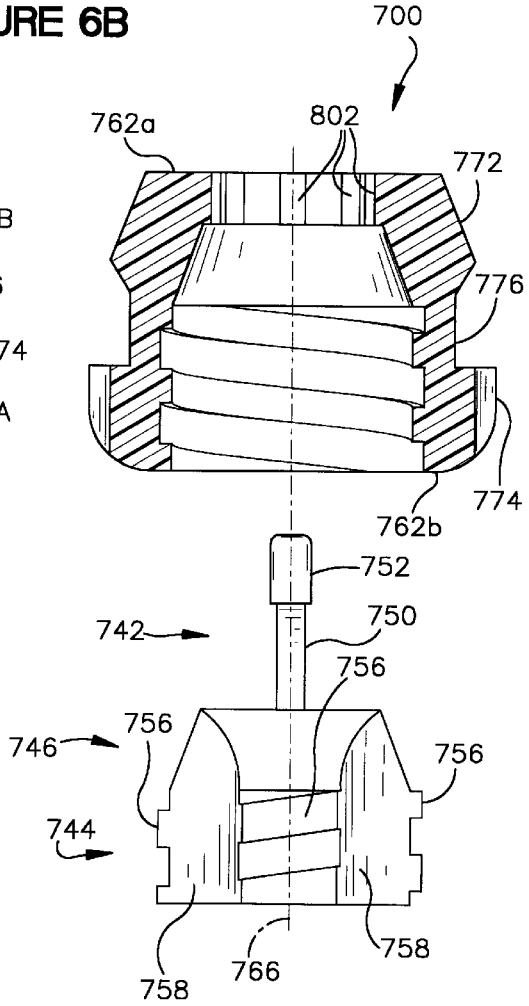
Figure 8A:
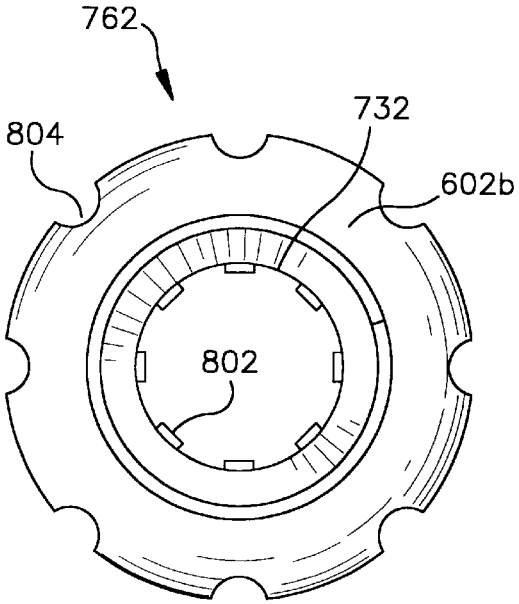
Figure 8B:
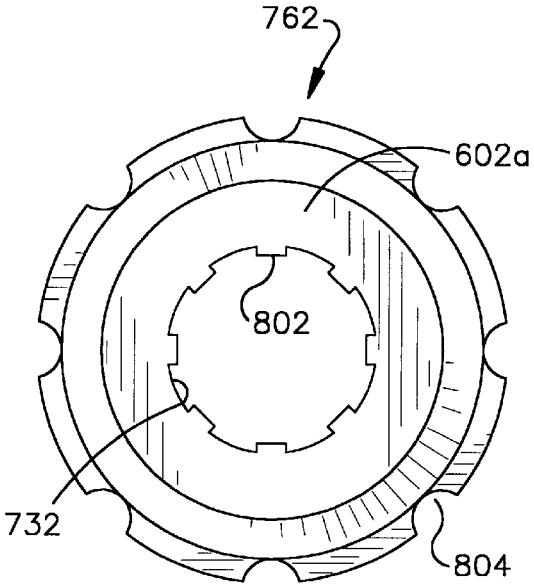
Figure 9A:
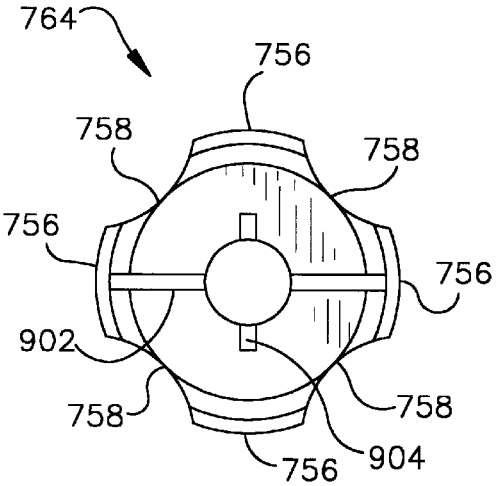
Figure 9B:
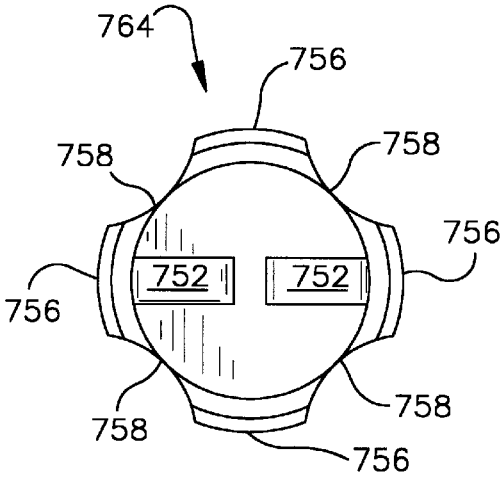

The structure, operation, and advantages of the present preferred embodiments of the invention will become further apparent upon consideration of the following description taken in conjunction with the accompanying drawings, wherein:

FIG. 1 is a cross-sectional view of a flapper-type flush valve pivotally mounted to an overflow pipe, in a closed position, according to the prior art;

FIG. 2 is a cross-sectional, exploded view of a flapper-type flush valve, according to the invention;

FIG. 3 is a bottom plan view of a flapper body component of the flapper-type flush valve shown in FIG. 2, according to the invention;

FIG. 4 is a side view of a mounting adapter of the present invention;

FIG. 5 is a top view of the mounting adapter of FIG. 4, showing a "C"-shaped steel spring, according to the invention;

FIG. 6A is a side view of an air control valve, according to the invention;

FIG. 6B is a side view of the air control valve of FIG. 6A, rotated 90 degrees, according to the invention;

FIG. 7A is a side exploded view of the air control valve of FIG. 6A, showing the main body component in cross-section and the valve core component in full, according to the invention;

FIG. 7B is a side exploded view of the air control valve of FIG. 6B, showing the main body component in cross-section and the valve core component in full, according to the invention;

FIG. 8A is a bottom view of the valve body of the air control valve of FIG. 6A, according to the invention;

FIG. 8B is a top view of the valve body of the air control valve of FIG. 8A, according to the invention;

FIG. 9A is a bottom view of the valve core of the air control valve of FIG. 6A, according to the invention; and FIG. 9B is a top view of the valve core of FIG. 9A, according to the invention.

DETAILED DESCRIPTION OF THE INVENTION

A flapper-type flush valve 100 of the prior art has been described hereinabove. A flapper-type flush valve of the present invention is described hereinbelow. A mounting adapter of the present invention is described hereinbelow. An adjustable air flow control valve of the present invention is described hereinbelow.

Multiple Component Flush Valve

FIG. 2 illustrates an embodiment of the flapper-type toilet flush valve 200 of the present invention. The flush valve 200 (compare 100) comprises an upper flapper body component 202 (compare 102) and a lower float member component 204 (compare 104), both of which are suitably formed of resilient plastic compounds that resist chlorine and chemical bleaches of the type commonly used in tank style toilets and that accelerate the deterioration and failure of conventional soft, rubber style toilet flush valves and cause them to leak badly and waste valuable water resources and money.

The flapper body component 202, which is also shown in bottom plan view in FIG. 3, is generally in the form of a disc, having an upper surface 202*a* and a lower surface 202*b*. The float member component 204 attaches to the lower surface 202*b* of the flapper body component 202, as described in greater detail hereinbelow. A pair of generally parallel, spaced-apart arms 206 extend in a rearward direction from a rearward position (right hand side, as viewed) of the flapper body component 202. A hole 208 is provided in a distal end of each arm 206 for pivotally securing the flush valve 200 to a corresponding pair of pins or trunnions (not shown, compare 110) extending from an overflow pipe (not shown, compare 112). The arrangement of arms 206, holes 208 and trunnions allow the flush valve 200 to pivot between a "closed" position atop a top end (not shown, compare 114*a*) of a discharge pipe (not shown, compare 114) functioning as a valve seat, and an "open" position as described hereinabove.

A chain or strap (not shown, compare 116) extends from a flush lever lift arm (not shown) to a mounting lug 218 (compare 118) which is disposed on the front (left, as viewed) of the flapper body component 202, generally diametrically-opposed to the rearwardly-extending arms 206. When the flush lever lift arm is operated (e.g., depressed), the chain pulls upward on the flush valve 200, causing the flapper body component 202 to move away from the top end of the discharge pipe, thereby "opening" the flush valve 200 and initiating flushing of the toilet, as described hereinabove.

The float member component 204 is cup-shaped, defining an air chamber 220 (compare 120). The air chamber 220 is typically sized to contain 2.25 to 2.50 cubic inches of air. An opening 222 (compare 122) is located at the base of the float member component 204. In use, when the flush valve 200 is opened, the buoyancy of the air inside the air chamber 220 assists in maintaining the flush valve 200 in the open position until the water level drops below the float member component 204, at which time the weight of the flapper body component 202 causes the flush valve to drop and close. Since prior art one-piece float valves (e.g., 100) have a flapper body (e.g., 102) and float member (e.g., 104) integrally formed with one another, a failure of only a portion of such an integrally-formed flush valve would require the replacement of the entire float valve. The assembly of flapper body component 202 and float member component 204 allow for the replacement of only a defective component, rather than the entire flush valve 200.

As best viewed in FIG. 2, the lower surface 202*b* of the flapper body component 202 is recessed, forming an annular recess 230. A plurality (three are shown) of spaced-apart locking lugs 232*a*, 232*b* and 232*c* are provided on the inside surface 230*b* of the annular recess. These lugs 232*a*, 232*b* and 232*c* may be evenly-spaced, or unevenly-spaced. The top edge 204*a* of the float member component is provided with a corresponding plurality (three are shown) of spaced-apart lug teeth 234*a*, 234*b* and 234*c* which mate with the lugs 232*a*, 232*b* and 232*c*, respectively, when the float member component 204 is assembled to the flapper body component 202. This is suitably a so-called "bayonet" type of mounting, where one part (e.g., 204) is inserted into another part (e.g., 202), then twisted to secure (releasably interlock) the two parts together. (Compare typical pill bottle twist caps.) It is within the scope of the invention that the float member component 204 is assembled by threading, rather than by twisting, to the flapper body component 202.

The float member component 204 has an annular flange 236 near its top edge. A top (as viewed) surface 236*a* of the annular flange 236 is a sealing surface. A corresponding portion of the lower surface 202*b* of the flapper body component 202 is also a sealing surface. Preferably, prior to assembling the float member component 204 to the flapper body component 202, a seal ring 240 is disposed between the two components, between their respective two sealing surfaces.

The seal ring 240 is in the form of a planar disc, having a central opening, and is formed of very flexible, thermoplastic material which is highly resistant to harsh chemicals normally found in the water supply. The top (as viewed) surface 240*a* of the seal ring 240 can include a raised, circular step 242 which provides an air tight seal between the assembled upper flapper body component 202, seal ring 240 and float member component 204. The locking lugs 232*a*, 232*b* and 232*c* and the lug teeth 234*a*, 234*b* and 234*c* can be disconnected by twisting the float member component 204 and the flapper body component 202 in an appropriate counter-clockwise or clockwise direction. This movement causes the teeth 234*a*, 234*b* and 234*c* to become disengaged from the locking lugs 232*a*, 232*b* and 232*c*, respectively, and also provides the means and method of changing the seal ring 240 in event of its damage or failure.

The sealing portion of the bottom surface 202*b* of the upper flapper body component 202 is best viewed in FIG. 3, wherein it can be observed that the sealing surface suitably comprises three concentric rings 248*a*, 248*b*, 248*c* which are raised slightly to provide a means and method for visually centering the seal ring 240.

As best viewed in FIG. 2, in addition to the mounting lug 218 on the front of the flapper body component 202, an "S" chain mounting lug 219 may be included and positioned preferably centered on the forward top most point of the upper flapper body component 202.

Mounting Adapter

As mentioned above, holes (108, 208) are provided in the ends of arms (106,206) for pivotally securing the flush valve (100, 200) to a corresponding pair of pins or trunnions (110) extending from diametrically-opposed positions on an outer surface of an overflow pipe (112). In the event that the overflow pipe (112) does not have trunnions (110), a mounting adapter may be provided for pivotally mounting the flush valve to the overflow pipe (112).

FIGS. 4 and 5 illustrate a mounting adapter 400 of the invention for mounting a flush valve (not shown, compare 100, 200) to an overflow pipe (not shown, compare 112). The adapter 400 comprises a collar 402 and, as best viewed in FIG. 5, has a pair of trunnions 404*a* and 404*b* projecting radially outward from the collar 402 in diametrically opposed directions. The collar 402 is generally cylindrical (circular), and has a gap 406 so that the collar 402 can expand and be mounted to the overflow pipe by spreading open the collar 402 and sliding the collar 402 over the top of the overflow pipe and moving it down into an appropriate position near the base of the overflow pipe. A "C"-shaped stainless steel, rust-resistant spring 410 fits snugly about an outer surface of the collar 402 and provides a spring force that presses the interior surface 408 of the collar 402 against the outer surface of the overflow pipe to secure the mounting adapter 400 in place on the overflow pipe. In FIG. 5, the clip 410 is illustrated both before and after being fitted about the collar 402.

Adjustable Air Control Valve

An adjustable air control valve for a flapper-type toilet flush valve is now described. Generally, the air control valve of the present invention can be installed in the float member component (e.g., 104) of a conventional toilet flush valve (e.g., 100) or can be installed in the float member component 204 of the flush valve 200 of the present invention. In either case, the adjustable air control valve provides a technique for controlling the rate at which air enters the chamber 120, 220 of the float member 104, 204, thereby controlling the rate at which the toilet flush valve closes, thereby controlling (e.g., limiting) the amount of water that is released from the toilet tank into the toilet bowl during a normal flush—in other words, how much water is used to flush the toilet, even when the toilet has a large (e.g., 8 gallon) tank.

FIG. 6A illustrates the adjustable air control valve 600 of the present invention. The air control valve 600 comprises a valve body 662 and a valve core 664. FIG. 6B illustrates the same adjustable air control valve 600 with the valve core 664 turned 90 degrees on its axis 666.

The air control valve 600 is generally cylindrical overall, having a top end 600*a* and a bottom end 600*b*, and is sized and shaped to be inserted into an opening 622 (compare 122, 222) at the base of a float member 604 (compare 104, 204). The overall purpose of the air control valve 600 is to selectively limit (throttle down) the amount of air entering the chamber 620 (compare 120, 220) of the float member 604 (104, 204), thereby controlling the rate at which the flush valve closes, thereby reducing the quantity of water used to flush the toilet. The float member 604 has an air exhaust vent hole 624 for allowing air to escape from the chamber 620 as it is displaced by water entering the chamber 620.

FIGS. 7A and 7B illustrate a preferred embodiment of the air control valve 700. FIG. 7A illustrates the air control valve 700, in an exploded view, with the valve body 662 shown in cross-section and separated from the valve core 764 which is shown in full. The valve core 764 has the same orientation on its axis 766 as in FIG. 6A. FIG. 7B illustrates the air control valve 700, again in an exploded view, with the valve body 762 shown in cross-section and separated from the valve core 764 which is shown in full, with the valve core turned 90 degrees on its axis 766, as in FIG. 6B. The valve core 764 is suitably shown in full in FIGS. 7A and 7B because it is not hollow. In contrast thereto, the valve body 762 is hollow, and warrants showing in cross-section.

The valve body 762 is generally cylindrical, has a top end portion 772, a bottom end portion 774 and a middle portion 776. The middle portion 776 has an OD (outside diameter) which is approximately equal to the diameter of the opening 622 in the float member 626. The top end portion 772 is tapered, and has a maximum OD which is greater than the diameter of the opening 622 in the float member 626. The taper of the external surface of the top portion 772 of the valve body 762 provides the means to slidingly insert the valve 700 into the opening 622 at the base of float member 626. The bottom end portion 774 has an OD which is greater than the diameter of the opening 622 in the float member 626, to limit how far the valve body 762 can be inserted into the opening 622. The two end portions 702 and 704, both having a larger diameter than the opening 622 in the float member 626, ensure that the air control valve 700 will not accidentally be dislodged from the float member 626.

A bore 730 extends completely through the valve body 762, from the top 762*a* to the bottom 762*b* thereof, and has an opening 732 at the top 762*a* of the valve body 762 and an opening 734 at the bottom 762*b* of the valve body 762. The interior wall of the bore 730 is provided with a spiraling (helical) thread 736, as illustrated. The thread 736 is preferably continuous, rather than segmented. As described hereinbelow, the valve core 764 has an external thread which cooperates with the thread 736 to adjust the position of the valve core 764 in the valve body 762.

As best viewed in FIGS. 7A and 7B, a top portion of the bore 730 is tapered (frustro-conical), and the top bore opening 732 has a smaller diameter than the bottom bore opening 734. As described in greater detail hereinbelow, the bore 730 permits air to flow into the chamber 620 in the float member 604, the rate of which can be regulated by the valve core 664.

The valve core 764 has a top portion 742, a bottom portion 744 and a middle portion 746.

As best viewed in FIGS. 7A and 7B, the top portion 742 comprises two parallel, spaced-apart arms 750 which terminate in tabs 752 which, when compressed towards one another, fit through the opening 732 in the valve body 762, allowing the valve core 764 to be inserted into the valve body 762. The middle portion 746 of the valve core 764 is tapered (frustro-conical). The bottom portion 744 of the valve core 764 is generally cylindrical, and is threaded and fluted. More particularly, a thread 756 spirals around the exterior surface of the bottom portion 744 of the valve core 764. This thread 756 is the mate to the thread 736 in the valve body 762, and allows the valve core 764 to be threaded into the valve body 762. As described in greater detail hereinbelow, how far the valve core 764 is threaded into the valve body 762 determines the flow rate through the valve 700.

FIGS. 8A and 8B are a bottom and top view (respectively) of the valve body 762, and FIGS. 9A and 9B are a bottom and top view (respectively) of the valve core 764. Referring to FIGS. 7A, 7B, 8A, 8B, 9A and 9B, the valve core 764 is provided with a plurality of flow channels (grooves, "flutes") 758 extending axially along the outer surface of the bottom portion 744 of the valve core 764, continuing along the outer surface of the middle portion 746. Air flows along these channels 758, and is metered by how far the valve core 764 is threaded into the valve body 762. The channels 758 interrupt the continuity of the thread 756, as shown in FIGS. 7A, 7B, 9A and 9B.

As best viewed in FIG. 8B (but also seen in the far end of FIG. 8A), a top view of the valve body 762, the opening 732 at the top 762*a* of the valve body 762 is scalloped, having a plurality (eight shown) of teeth 802 protruding radially into the bore. When the valve core 764 is inserted into the valve body 762, the tabs 752 at the end of the arms 750 resiliently engage the valve body 762 by snugly fitting between diametrically opposed spaces between selected ones of the teeth 802. This prevents the valve core 764 from turning and also prevents the valve core 764 from falling out of the valve body 762. In order to turn the valve core 764, one must compress (pinch) the two arms 750 together, releasing them from the teeth 802. After turning the valve core 764 a desired amount, the arms 750 are released, return to their original shape, and seat within the diametrically opposed gaps between the teeth 802.

Also shown in FIGS. 7A, 7B, 8A and 8B are a plurality of scallops 804 about the periphery of the bottom portion 744 of the valve body 762. These scallops 804 are merely to aid in grasping the valve body 762, in a manner akin to "knurling".

As best viewed in FIGS. 7A and 7B, a top portion of the bore 730 of the valve body 702 is tapered. This taper, and the location of the taper, correspond to the taper of the valve core 764 when the valve core 764 is fully threaded into the valve body 762. Fully screwing the valve core 764 into the valve body 762 will shut off flow through the valve 700. By selectively screwing the valve core 764 only partially into the valve body 762, a flow rate through the valve may be selected by the user from substantially zero to fully opened simply by turning the valve core 764 into or out of the interior threads of the valve body 762 so that the tapered exterior surface of the valve core 764 is moved closer to or further from the tapered internal surface of the valve body 762. By increasing the distance between the tapered surfaces, air flow through the valve is increased. By decreasing the distance between the tapered surfaces, air flow through the valve is decreased.

In operation, when the flush valve 100 is raised during flushing, tank water enters float member 604 through air control valve 600 while air exits through vent hole 624. After the tank water recedes, the flapper body 202 drops down and seals the discharge pipe 114. The greater the water flow (through the air control valve 600) into the float member 604, the heavier the float member 604 becomes, and the sooner it drops to seal the discharge pipe 114. Hence, the air control valve 600 can be adjusted to control the amount of water discharged on each flush.

As best viewed in FIG. 9A, a bottom surface of the valve core 764 is equipped with two grooves 902 and 904 that intersect at their midpoints and provide the means for using either a slot-type or cross-tip (Phillips) type screw drive to adjust the position of the valve core 764 in the valve body 762.

While the invention has been described in combination with embodiments thereof, it is evident that many alternatives, modifications, and variations will be apparent to those skilled in the art in light of the foregoing description. Accordingly, the invention is intended to embrace all such alternatives, modifications and variations as fall within the spirit and broad scope of the appended claims.

What is claimed is:

1. Flapper-type toilet flush valve comprising:

a flapper body component having an upper surface and a lower surface;

a float member component assembled by bayonet type mounting to the flapper body component;

an annular flange extending from the float member component near its top edge, a top surface of the flange forming a first sealing surface;

a portion of the lower surface of the flapper body component forming a second sealing surface;

a sealing ring having an inner diameter, an outer larger diameter, upper and lower surfaces there-between, and a preformed, raised circular step on the upper surface thereof offset from and positioned between the inner and outer diameters, wherein the preformed, raised circular step is being disposed between the first and second sealing surfaces; and a number of slightly raised concentric rings extending from the second sealing surface, wherein the preformed, raised circular step is fitted in between the concentric ring for centering the seal ring onto the flapper body component and for providing an air tight seal between the flapper body component and the float member component.

2. Flush valve, according to claim 1, wherein:

the flapper body and float member components are formed of resilient plastic compounds that resist chlorine and chemical bleaches of the type commonly used in tank style toilets.

3. Flush valve, according to claim 1, further comprising:

a pair of generally parallel, spaced-apart arms extending from the flapper body component; and a hole in a distal end of each arm for pivotally securing the flush valve to an overflow pipe;

thereby enabling the flush valve to pivot between a closed position atop a top end of a discharge pipe and an open position.

4. Flush valve, according to claim 1, further comprising:

a mounting lug disposed on the upper surface of the flapper body component.

5. Flush valve, according to claim 4, wherein:

the mounting lug is positioned at a forward top most point of the flapper body component.

6. Flush valve, according to claim 1, wherein:

the float member component is cup-shaped and defines an air chamber;

further comprising:

an opening in the float member component for admitting water into the air chamber.

7. Flush valve, according to claim 6, wherein:

a vent hole in the float member component for allowing air to escape from the air chamber when water is being admitted into the air chamber through the opening.

8. Flush valve, according to claim 1, wherein the bayonet type mounting further comprises:

an annular recess formed in the lower surface of the flapper body component;

a plurality of spaced-apart locking lugs provided on an inside surface of the annular recess; and a plurality of spaced-apart teeth provided on a top edge of the float member component for mating with the locking lugs.

9. A flapper-type flush valve for use in a toilet tank assembly including a flush outlet surrounded by a valve seat, an overflow pipe and a movable lift arm to initiate flow of water through said valve seat, said flush valve comprising:

a resilient plastic flapper having a upper surface, a lower sealing surface, a number of raised concentric rings extending from the lower sealing surface thereof; and two rearwardly projecting arms for attaching the flapper to the overflow pipe;

a detachable float removably attached to the flapper;

a replaceable seal ring made of very flexible, thermoplastic material, disposed between the flapper and the float, the seal ring having an inner diameter, an outer larger diameter, and upper and lower surfaces there-between; and a preformed, raised circular step on the upper surface thereof offset from and positioned between the inner and outer diameters, wherein the performed, raised circular step is fitted in between the concentric rings for centering the seal ring onto the flapper and for providing an air tight seal between the flapper and the float.

10. Flush valve, according to claim 9, further comprising:

lugs on an interior surface of the flapper and teeth on a top edge of the float, the teeth interlocking with the lugs.

11. Flush valve, according to claim 9, further comprising:

means for attaching a ball chain or S chain to the flapper for initiating water flow through the valve seat.

12. Flapper-type toilet flush valve for use in a toilet tank comprising:

a flapper component having an upper surface and a lower sealing surface; and a float member assembled to the lower sealing surface of the flapper component;

a seal ring having an inner diameter, an outer larger diameter, upper and lower surfaces there-between, and a performed, raised circular step on the upper surface thereof offset from and positioned between the inner and outer diameters, wherein the preformed, raised circular step is being disposed between the float member and the sealing surface of the flapper component; and a plurality of slightly raised concentric rings disposed on the lower sealing surface of the flapper component, wherein the preformed, raised circular step is fitted in between the concentric rings for centering the seal ring onto the flapper body component and for providing an air tight seal between the flapper body component and the float member component.

13. Flush valve, according to claim 12, wherein:

the flapper component and float member components are formed of resilient plastic compounds that resist chlorine and chemical bleaches of the type commonly used in tank style toilets.

14. Flush valve, according to claim 12, wherein:

the float member is assembled by bayonet type mounting to flapper component.

15. Flush valve, according to claim 12, further comprising:

a raised circular step on the seal ring.

16. Flush valve, according to claim 12, wherein:

the seal ring comprises a very flexible, thermoplastic material.

* * * * *